United States Patent [19]

Wedel

[11] Patent Number: 4,669,198

[45] Date of Patent: Jun. 2, 1987

[54] BLOW BOX FOR A DRYER

[75] Inventor: Gregory L. Wedel, Beloit, Wis.

[73] Assignee: Beloit Corp., Beloit, Wis.

[21] Appl. No.: 857,747

[22] PCT Filed: Apr. 8, 1986

[86] PCT No.: PCT/US86/00745

§ 371 Date: Apr. 8, 1986

§ 102(e) Date: Apr. 8, 1986

[51] Int. Cl.[4] ..... F26B 13/08

[52] U.S. Cl. ..... 34/23; 34/41; 34/114; 34/116; 34/117

[58] Field of Search ..... 34/114, 116, 117, 122, 34/123, 23, 41

[56] References Cited

U.S. PATENT DOCUMENTS 4,516,330 5/1985 Eskelinen et al. ..... 34/114

4,553,340 11/1985 Petersson ..... 34/123

*Primary Examiner*—Larry I. Schwartz

*Attorney, Agent, or Firm*—Dirk J. Veneman; Raymond W. Campbell; David J. Archer

[57] ABSTRACT

A blow box (40) is disclosed which is disposed within a pocket (26) defined by a web (W) and felt (F) travelling together from a first dryer (12) to and around a second dryer (14) and onto and around a third dryer (16). The blow box (40) includes a wedge-shaped box extending from between the first and third dryers (12 and 16) to adjacent the second dryer (14), the box (40) being connected to a source of pressurized air (42) for maintaining the web (W) in close conformity with the felt (F) when the web and felt diverge relative to the first dryer (12). The box (40) defines an orifice (44) which is disposed adjacent to the first dryer (12) for directing pressurized air against the felt and then redirecting the air in a direction opposite to the direction of rotation of the first dryer (12) such that the web is urged against the felt for inhibiting the tendency of the web to adhere to the first dryer (12) when the felt diverges relative to the first dryer (12).

16 Claims, 8 Drawing Figures

FIG. 8
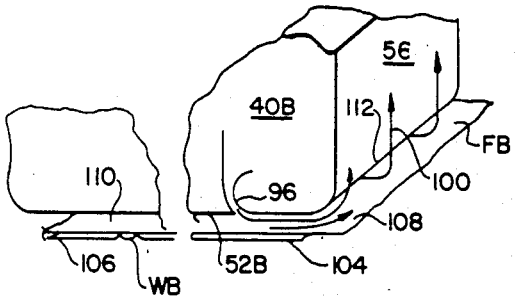
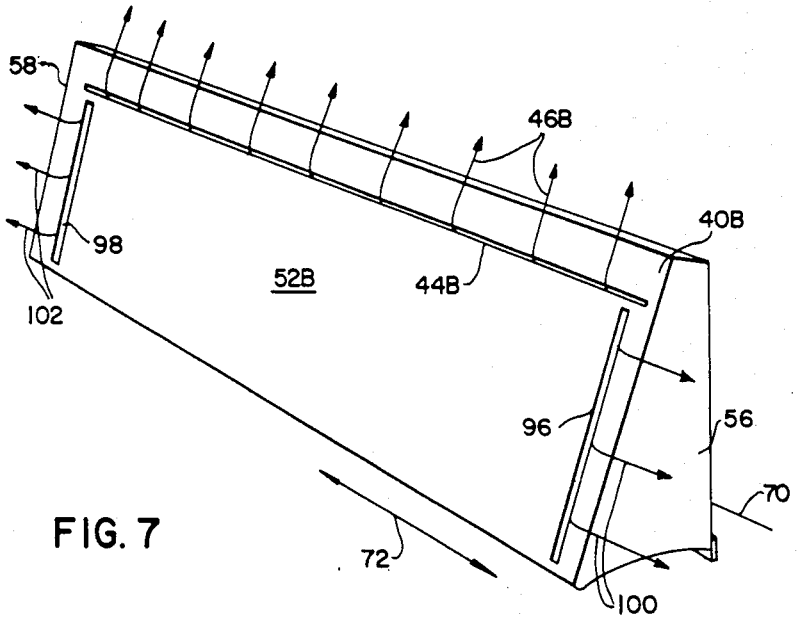
FIG. 7

BLOW BOX FOR A DRYER

BACKGROUND OF THE INVENTION

1. Field of the Invention

This invention relates to a blow box and a method of using the blow box for inhibiting any tendency of a web to adhere to a dryer when the felt diverges relative to the dryer. More specifically, this invention relates to a blow box used in the dryer section of a papermaking machine.

2. Information Disclosure Statement

In the process of manufacturing paper, ever increasing production speeds are encountered. In order to provide support for a wet web of paper between dryer cylinders in such high-speed production of paper, it has now become customary to use a single support felt in an entire section of dryers. This felt is guided in a serpentine fashion through the two-tier dryer groups such that the felt is guided through the upper and lower dryer groups. The felt runs alternately over a top cylinder, then under a bottom cylinder and over a top cylinder of the dryer groups with the web being sandwiched between the felt and the top cylinder and being carried on the outer surface of the felt as the felt and web pass under the bottom cylinder. This arrangement is capable of providing complete support of the web through the entire dryer group provided that the web remains in contact with the felt.

However, with the advent of ever-increasing dryer speeds and particularly with speeds over 3,000 feet per minute, the web has a tendency not to stay in contact with the felt. There exist two main reasons for such tendency of the web to part from the felt. First, as the web and felt leave the top dryer cylinder, the web experiences a suction force produced by the dryer as the dryer surface separates from the web. This force tends to pull the web off of the dryer felt where the felt diverges from the top dryer. Second, the air which is entrained by the rotating bottom dryer and that portion of the felt moving between the top and bottom dryer is pumped through the felt at the converging nip. Such pumping or relatively high air pressure exists where the felt converges with the bottom dryer. Such air also tends to force the web off the dryer felt at such converging nip.

Prior proposals have attempted to control this "blowing" problem but have been directed mainly at the buildup of pressure at the converging nip.

More specifically, U.S. Pat. No. 4,516,330 to Valmet and U.S. Pat. No. 4,502,231 to Voith describer hereinafter attempt to control and reduce the pressure in the vicinity of the aforementioned converging nip.

Both of these prior proposals suffer from two primary disadvantages. First, neither of these devices address the immportance of keeping the web in tight conformity, or contact, with the felt right from the release point or diverging nip adjacent to the top dryer. Such tight contact is essential since once the web has pulled away from the felt at the diverging nip, the web has some slackness which will later allow the web to say away from the felt in response to centrifugal force as the web passes around the bottom dryer.

Furthermore, the prior proposals both teach the discharge of pressurized air into the pocket area above the bottom dryer. Such air tends to produce an over pressure in the pocket which further acts to blow the sheet off of the felt at the critical up run between the bottom dryer and a subsequent top dryer.

The present invention provides a blow box which overcomes the aforementioned disadvantages of the prior proposals and provides a blow box which makes a significant contribution to the art of web drying in a paper machine.

A primary objective of the present invention is the provision of a blow box which produces a high level of vacuum adjacent to the diverging nip of a top dryer in order to inhibit any tendency of the web to stick to the surface of the top dryer when the felt diverges relative to the top dryer.

Another objective of the present invention is the provision of a blow box having a diverging wall for inducing a partial vacuum between the box and the adjacent felt for enhancing the cohesion between the web and the felt between the top and bottom dryer.

Another object of the present invention is the provision of a blow box having a seal between the box and the bottom dryer for inhibiting the buildup of pressure at the converging nip between the felt and bottom dryer.

Another object of the present invention is the provision of a blow box which is pivotally-secured relative to the top dryer such that the blow box is able to tilt away from the top dryer in the event of the web becoming enwrapped around the top dryer.

Another object of the present invention is the provision of a blow box having a base wall which defines a opening for directing a flow or air from within the box to the pocket for inducing a partial vacuum within the pocket which tends to maintain the web in close conformity with the felt between the second and third dryers.

Another object of the present invention is the provision of a baffle which extends across the box for defining a first and second compartment, the flow of pressurized air in the first compartment inducing a partial vacuum in the second compartment such that air flows from the converging nip through a port defined by the second compartment for inhibiting any tendency of the web to part form the felt as the web passes around the second dryer.

Another object of the present invention is the provision of a first and second slot disposed adjacent to the first and second end walls of the blow box for directing a first and second current of air sideways relative to the pocket thereby avoiding the necessity for the end plate seals.

Other objects and advantages of the present invention will be readily apparent to those skilled in the art form the detailed description, drawings and appended claims.

SUMMARY OF THE INVENTION

The present invention relates to a blow box and a method of using the blow box. The blow box is disposed within a pocket defined by a web and felt travelling together from a first dryer to and around a second dryer and onto and around a third dryer. The blow box includes a wedge-shaped box extending from between the first and third dryers to adjacent the second dryer. The box is connected to a source of pressurized air for maintaining the web in close conformity with the felt when the web and felt diverge relative to the first dryer. The box defines an orifice which is disposed adjacent to the first dryer for directing pressurized air towards the felt and then redirecting the air in a direction opposite to the direction of rotation of the first dryer such that additional air is entrained so that a partial vacuum is produced and the web is urged against the felt for inhibiting the tendency of the web to adhere to the first dryer when the felt diverges relative to the first dryer.

More specifically, the blow box includes a base wall wich extends radially relative to the second dryer to midway between the first and third dryers, the base wall extending in a cross machine direction. A curved wall extends from the base wall towards where the web and felt converge relative to the second dryer. The curved wall conforms to the periphery of the second dryer and extends in a cross machine direction. A diverging wall is disposed opposite to the base wall with the diverging wall extending from the curved wall towards the first dryer. The diverging wall also extends in a cross machine direction. A connecting wall is disposed opposite to the curved wall with the connecting wall extending between the diverging wall and the base wall for connecting the base and diverging walls together. A first and second end wall are separated relative to each other in a cross machine direction and are secured respectively to the base, curved, diverging and connecting walls for defining therebetween the wedge-shaped box.

In a specific embodiment of the present invention, the diverging wall diverges relative to the felt in a direction from the first towards the second dryer for inducing a partial vacuum between the felt and the diverging wall when the web and felt are moving relative to the box. The diverging wall and that portion of the felt between the first and second dryers are disposed in first and second planes respectively with the planes being disposed angularly relative to each other within the range of 0.1–5.0 degrees such that when the speed of movement of the felt and web in close conformity with the felt increases and the tendency of the web to part from the felt accordingly increases, the induced partial vacuum brought about by the diverging wall correspondingly increases to compensate for such tendency of the web to part from the felt.

The blow box includes an air deflector brush which extends between the base wall and the periphery of the second dryer such that when the second dryer rotates, air within the pocket and in the vicinity of the periphery of the second dryer is inhibited from flowing between the curved wall and the periphery of the second dryer towards where the web and felt converge relative to the second dryer such that the deflector means deflects the air in the vicinity of the periphery of the second dryer along the base wall and out of the pocket. The air being deflected along the base wall out of the pocket tends to induce a partial vacuum within the pocket between the base wall and the web and felt disposed between the second and third dryers and such partial vacuum adjacent to the web and felt between the second and third dryers enhances cohesion of the web to the felt between the second and third dryers.

The blow box is pivotally-mounted relative to the first dryer so that in the event of the web breaking and becoming enwrapped around the first dryer, the box tilts relative to the first dryer such that the diverging wall moves away from the first dryer to inhibit damage to the box.

The base wall of the blow box also defines an opening for directing a flow of air from within the box to the pocket such that the flow of air flows out of the pocket to induce a partial vacuum within the pocket between the base wall and the felt disposed between the second and third dryers. This induced partial vacuum tends to maintain the web in close conformity with the felt between the second and third dryers.

A baffle is disposed within, and extends across, the box between the diverging and base walls such that the box defines a first and second compartment. The first compartment is connected to a source of pressurized air and defines a hole which is in fluid communication with the second compartment such that a partial vacuum is induced within the second compartment as a result of air flowing from the hole towards an opening defined by the base wall. The second compartment defines a port disposed adjacent to where the web and felt converge relative to the second dryer so that air flows through the port into the second compartment for inhibiting any tendency of the web to part from the felt as the web passes around the second dryer.

More specifically, the orifice of the blow box is an elongate slot extending in a cross machine direction for directing a current of air towards the felt and then redirecting the air by means of an orifice or nozzle having a curved surface in a direction opposite the direction of rotation of the first dryer for inhibiting any tendency of the web to stick to the first dryer surface rather than closely conforming to the felt between the first and second dryers.

The diverging wall of the blow box defines a first and second slot disposed adjacent to the first and second end walls respectively for directing a first and second current of air sideways relative to the pocket for urging the respective edges of the web against the felt thereby inhibiting sideways flow of hot air from the pocket.

The detailed description of the preferred embodiment of the present invention merely sets forth one way of accomplishing the aforementioned objectives and it should be appreciated by those skilled in the art that the present invention is not limited to the embodiments as described hereinbefore. Rather, the present invention is defined by the appended claims which include various alternatives which will be readily apparent to those skilled in the art and which alternative embodiments are encompassed by the appended claims. Such alternatives do not depart from the spirit and scope of the present invention as defined by the appended claims. Although the present invention has been described with particular reference to the drying of a web in the dryer section of a papermaking machine, it will be readily apparent to those skilled in the art that this invention will also be applicable to the drying of any type of web material. Furthermore, the blow box of the present invention may be easily modified to assist in the transfer of a web from the press section to a dryer section of a papermaking machine.

BRIEF DESCRIPTION OF THE DRAWINGS

FIG. 7 is a perspective view of a further embodiment of the present invention showing a blow box having a first and second slot disposed adjacent to the first and second end walls; and FIG. 8 is a fragmentary perspective view of the blow box shown in FIG. 7 with the junction of the diverging wall and end wall being beveled.

Similar reference characters are used throughout the various embodiments of the present invention to indicate corresponding parts.

DETAILED DESCRIPTION

Figure 1:
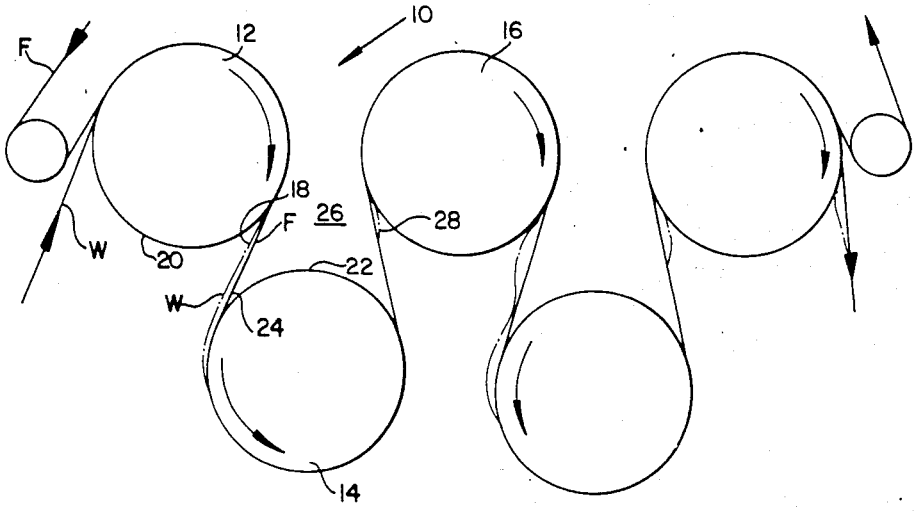
FIG. 1 PRIOR ART
FIG. 1 is a side elevational view of a portion of a typical dryer section showing the tendency of the web to part from the felt.

FIG. 1 of the present invention shows a portion of a dryer section generally designated 10. The dryer section 10 includes at least a first, second and third dryer 12,14 and 16 respectively with the first and third dryers 12 and 16 being top dryers and the second dryer 14 being a bottom dryer. A felt F and a web W pass around the first dryer 12. The felt F and web W diverge relative to the first dryer 12 adjacent to the diverging nip 18. The felt and web travel together from the first dryer 12 to and around the second dryer 14 and onto and around the third dryer 16. As shown in FIG. 1, there exists a tendency for the web W at the diverging nip 18 to stick to the surface 20 of the first dryer 12 and to part from the felt F. Furthermore, air entrained in the vicinity of the periphery 22 of the second dryer 14 becomes trapped adjacent the converging nip 24 of the second dryer 14. The nip 24 is defined by the felt F between the first and second dryers 12 and 14 and the second dryer 14. Such buildup of pressure within the converging nip 24 tends to create a flow of air through the felt F which dislodges the web W relative to the felt F during passage of the felt and web around the second dryer 14. Similarly, on the up run of the web and felt from the second dryer 14 to the third dryer 16, if conventional air boxes are disposed within the pocket 26 defined by the travelling web W and felt F, such air boxes tend to increase the pressure of air within the pocket 26 thereby increasing the possibility of the web W detaching from the felt F on the up run particularly in the converging nip 28 of the third dryer 16.

Figure 2:
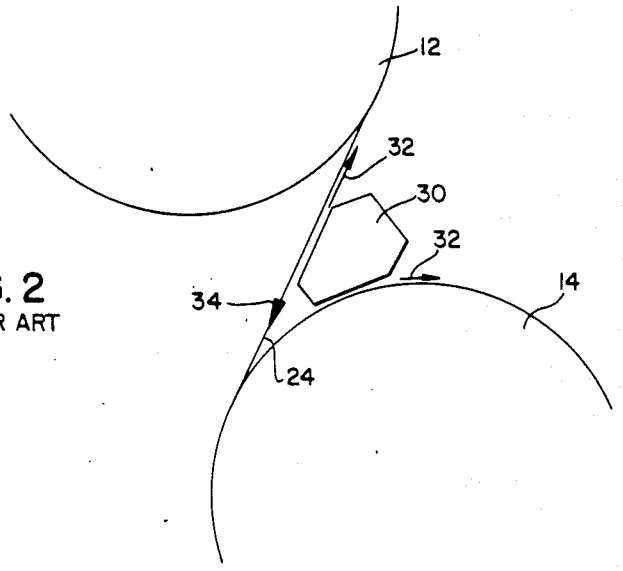
FIG. 2 PRIOR ART
FIG. 2 illustrates one prior proposal for enhancing cohesion between the web and felt.

FIG. 2 shows a prior art proposal for reducing the aforementioned pressure buildup at the converging nip 24. The prior art proposal includes a blow box 30 for directing pressurized air 32 in a direction opposite to the direction of movement as indicated by the arrow 34 of the felt between the first and second dryers 12 and 14 and thus reducing the air pressure at the converging nip 24.

Figure 3:
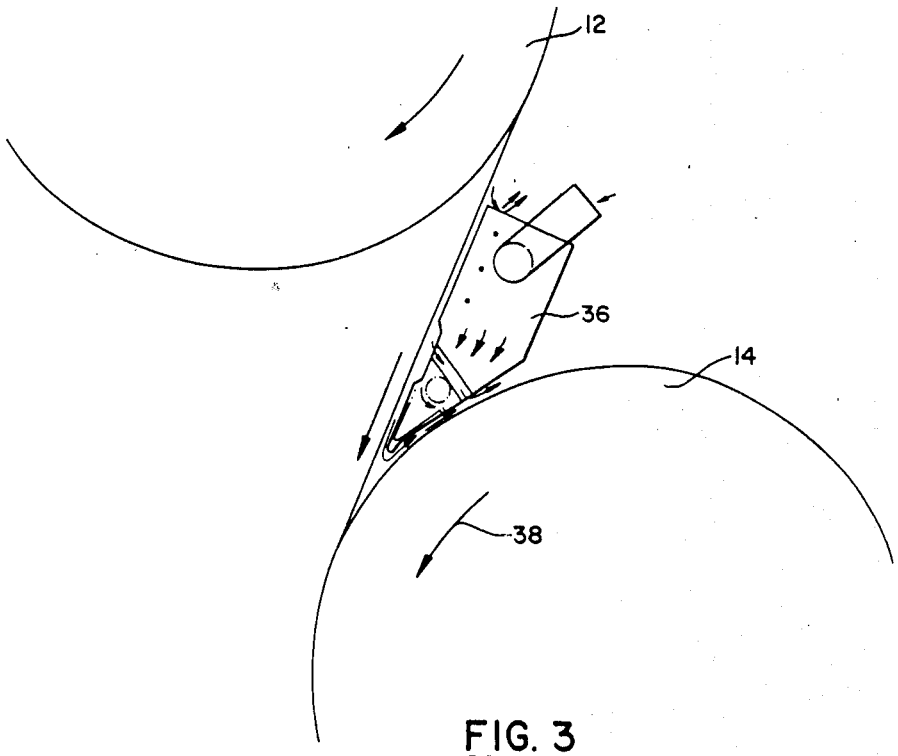
FIG. 3 PRIOR ART
FIG. 3 shows a further prior proposal for inhibiting the tendency of a web to part from a felt in the vicinity of the converging nip.

FIG. 3 shows another prior proposal including an air box 36 with means for directing a flow of air away from the felt between the first and second dryers 12 and 14 towards the periphery 22 of the second dryer 14 in a direction opposite to the direction of rotation of the second dryer as indicated by the arrow 38.

Figure 4:
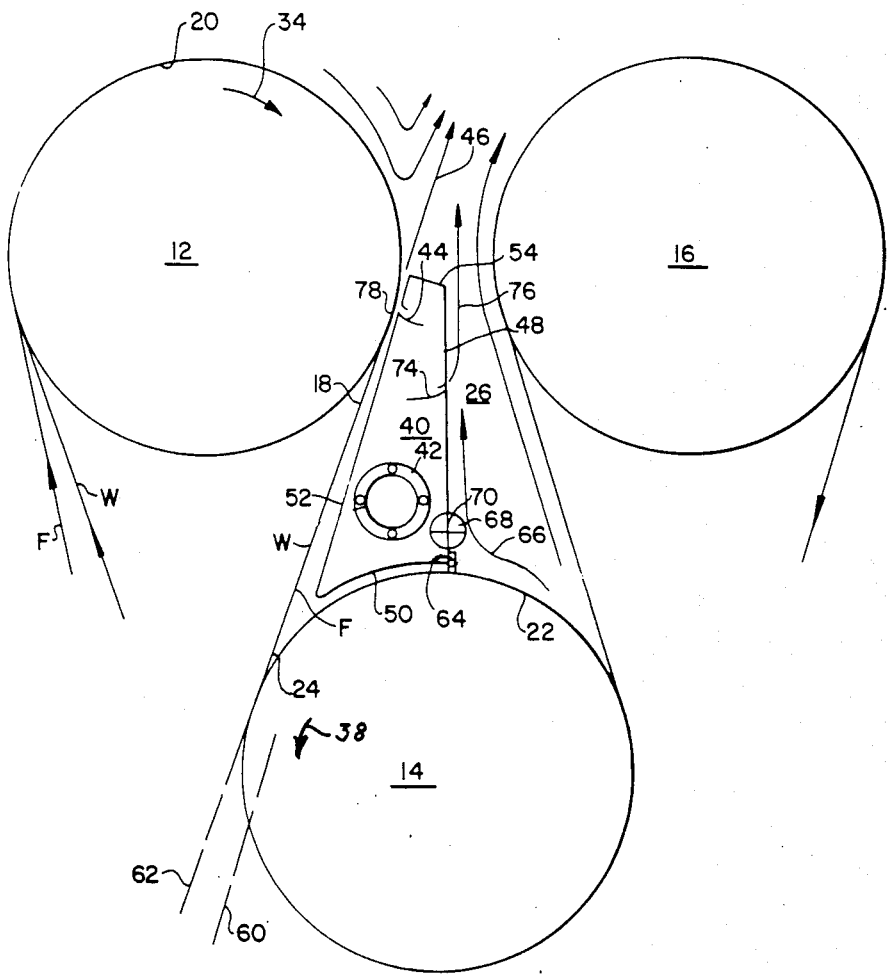
FIG. 4 is a side sectional view of the blow box according to the present invention.

FIG. 4 is a side sectional view of the air box 40 according to the present invention. The blow box 40 is disposed within the pocket 26 defined by a web W and felt F travelling together from a first dryer 12 to and around a second dryer 14 and onto and around a third dryer 16. The blow box 40 includes a wedge-shaped box extending from and between the first and third dryers 12 and 16 to adjacent the second dryer 14. The box 40 is connected to a source of pressurized air 42 for maintaining the web W in close conformity with the felt F when the web W and felt F diverge relative to the first dryer 12 at the diverging nip 18. The box 40 defines an orifice 44 disposed adjacent to the first dryer 12 for directing pressurized air indicated by the arrows 46 against the felt, then redirecting the air in a direction opposite to the direction of rotation as indicated by the arrow 34 of the first dryer 12 such that the web W is urged against the felt F for inhibiting the tendency of the web W to adhere to the surface 20 of the first dryer 12 when the felt F diverges relative to the first dryer 12.

As shown in FIG. 4, the air is redirected by providing a curved surface on one side of the orifice or nozzle so that the jet of air is redirected by the action of the Coanda effect. As shown in FIG. 4, the air is directed tangentially relative to the first dryer and in a direction opposite to the direction of rotation of the first dryer.

More specifically, as shown in FIG. 4, the blow box 40 is a wedge-shaped box which includes a base wall 48 extending radially relative to the second dryer 14 to midway between the first and third dryers 12 and 16. The base wall 48 extends in a cross machine direction as described hereinafter. A curved wall 50 extends from the base wall 48 towards the converging nip 24 where the web and felt converge relative to the second dryer 14. The curved wall 50 conforms to the periphery 22 of the second dryer 14. The curved wall 50 extends in a cross machine direction. A diverging wall 52 is disposed opposite to the base wall 48 with the diverging wall 52 extending from the curved wall 50 towards the first dryer 12. The diverging wall 52 extends in a cross machine direction. A connecting wall 54 is disposed opposite to the curved wall 50 with the connecting wall 54 extending between the diverging wall 52 and the base wall 48 for connecting the base and diverging walls 48 and 52 together. As shown in FIG. 7, a first and a second end wall 56 and 58 are separated relative to each other in a cross machine direction and are respectively secured to the base, curved, diverging and connecting walls 48, 50, 52 and 56 respectively for defining therebetween the wedge-shaped box 40.

The diverging wall 52 diverges relative to the felt F in a direction from the first dryer 12 towards the second dryer 14 for inducing a partial vacuum between the felt F and the diverging wall 52 when the web W and felt F are moving relative to the box 40. The diverging wall 52 is disposed in a first plane 60 and the felt F between the first and second dryers 12 and 14 respectively is disposed in a second plane 62. The first and second planes 60 and 62 are disposed angularly relative to each other for inducing a partial vacuum such that any tendency of the web W to depart from the felt F is inhibited by the partial vacuum. The partial vacuum increases proportionately to the speed of movement of the felt F relative to the diverging wall 52 such that when the speed of movement of the felt F and web W in close conformity with the felt F increases and the tendency of the web W to part from the felt accordingly increases, the induced partial vacuum increases correspondingly to compensate for such tendency of the web W to part from the felt F. In a preferred embodiment of the present invention, the first and second planes 60 and 62 diverge relative to each other at an angle within the range 0.1–5.0 degrees such that the partial vacuum induced by the diverging wall 52 helps to maintain the partial vacuum induced by the pressurized air 46.

Furthermore, the air box 40 includes an air deflector means generally designated 64 between the base wall 48 and the periphery 22 of the second dryer 14 such that when the second dryer 14 rotates, as indicated by the arrow 38, air as indicated by the arrow 66 within the pocket 26 and in the vicinity of the periphery 22 of the second dryer 14 is inhibited from flowing between the curved wall 50 and the periphery 22 of the second dryer 14 towards 24 where the web W and felt F converge relative to the second dryer 14. The deflector means 64 deflects the air in the vicinity of the periphery 22 of the second dryer 14 along the base wall 48 and out of the pocket 26. Preferably, the air deflector means 64 is a brush. The air deflector means, or brush 64, deflects air as indicated by the arrow 65 in the vicinity of the periphery 22 of the second dryer 14 along the base wall 48 and out of the pocket 26 thereby inducing a partial vacuum within the pocket 26 between the base wall 48 and the web W and felt F disposed between the second and third dryers 14 and 16 respectively. This partial vacuum adjacent the web and felt between the second and third dryers 14 and 16 enhances cohesion of the web W to the felt between the second and third dryers 14 and 16 respectively.

The blow box 40 is pivotally-mounted at 68 relative to the first dryer 12 such that in the event of the web W breaking and becoming enwrapped around the first dryer 12, the box 40 tilts relative to the first dryer 12 such that the diverging wall 52 moves away from the first dryer 12 to inhibit damage to the box 40. As shown in FIG. 4, the base wall 48 is pivotally-mounted at 68 so that the box 40 pivots about a pivotal axis 70 which is disposed parallel to the cross machine direction 72. This is shown in more detail hereinafter with reference to FIG. 7. As shown in FIG. 4, the pivotal axis 70 is disposed remote from the connecting wall 54.

The base wall 48 of the blow box 40 defines an opening 74 for directing a flow of air indicated by the arrow 76 from within the box 40 to the pocket 26 such that the flow of air 74 flows out of the pocket 26 to induce a partial vacuum within the pocket 26 between the base wall 48 and the felt F disposed between the second and third dryers 14 and 16 respectively. The induced partial vacuum tends to maintain the web W in close conformity with the felt F between the second and third dryers 14 and 16 respectively.

Figure 5:
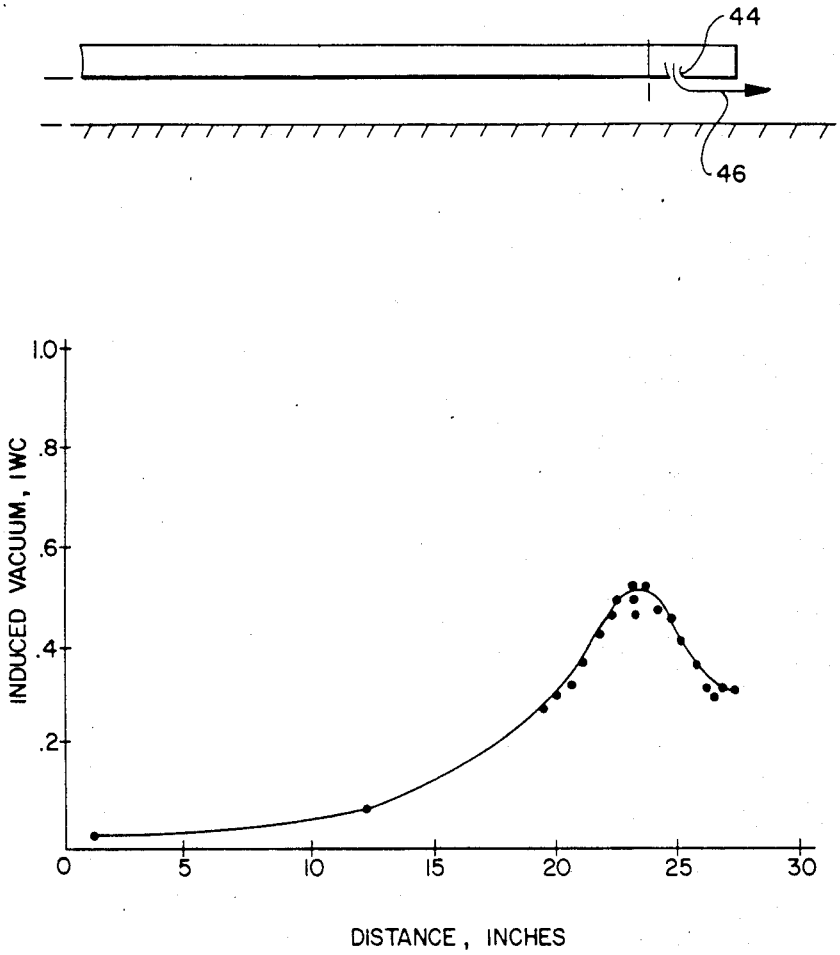
FIG. 5 is a graph showing the induced vacuum relative to various distances from the orifice of the blow box.

FIG. 5 is a graph showing the induced vacuum produced by the flow of air 46 passing through the orifice 44 and how such induced vacuum varies according to the distance measured from the orifice 44. As will be seen from the graph of FIG. 5, even when the orifice 44 is disposed nearer to the tangent point 78 of the felt F diverging from the first dryer 12 than to the second dryer, a high degree of usable vacuum is available for urging the web W to maintain contact with the felt F.

Figure 6:
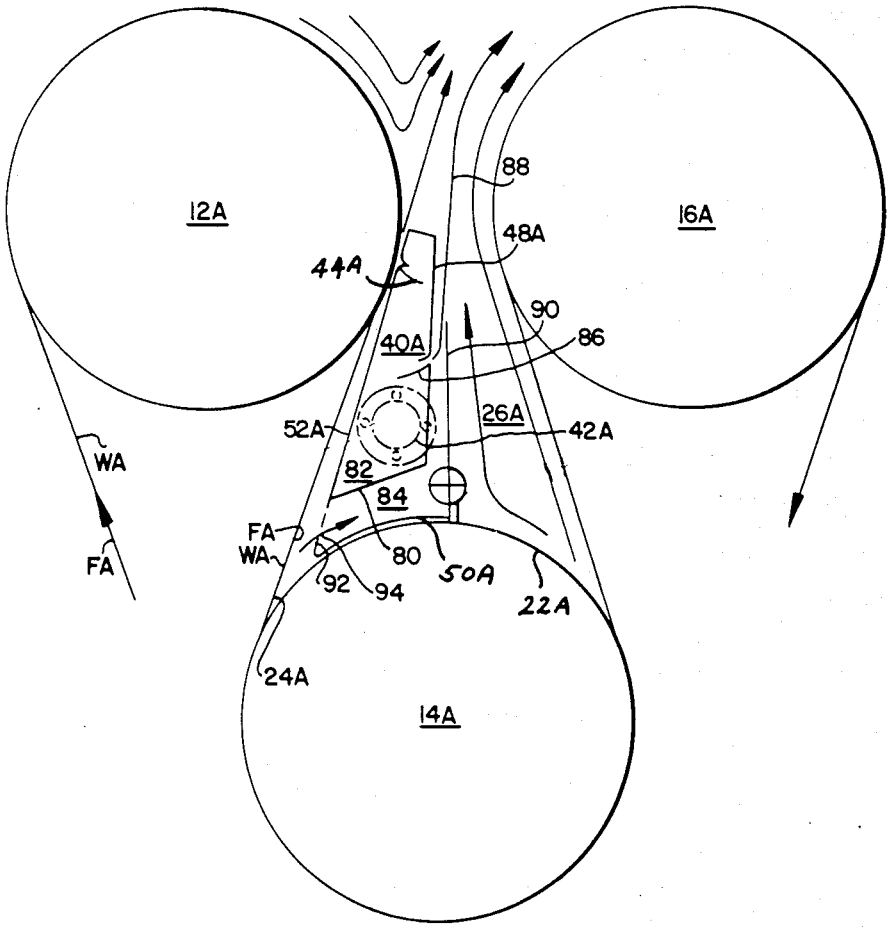
FIG. 6 is a side sectional view of an alternative embodiment of the present invention.

FIG. 6 is a side sectional view of an alternative embodiment of the present invention in which similar parts are indicated by the same numerals as those used in connection with the embodiment shown in FIG. 4. However, in the alternative embodiment of FIG. 6, the suffix A is added to the numerals.

FIG. 6 shows a first, second and third dryer 12A, 14A and 16A respectively with a web WA and felt FA passing therearound. A blow box 40A is disposed within the pocket 26A. The blow box 40A includes a baffle 80 disposed within and extending across the box 40A between a diverging wall 52A and a base wall 48A such that the box 40A defines a first and second compartment 82 and 84 respectively. The first compartment 82 is connected to a source of pressurized air 42A and the first compartment 82 defines a hole 86 which is in fluid communication with the second compartment 84 such that a partial vacuum is induced within the second compartment 84 as a result of air indicated by arrow 88 flowing from the hole 86 towards an opening 90 defined by the base wall 48A. The second compartment 84 defines a port 92 which is disposed adjacent to 24A where the web WA and felt FA converge relative to the second dryer 14A such that air indicated by the arrow 94 flows through the port 92 into the second compartment 84 for inhibiting any tendency of the web WA to part from the felt FA as the web WA passes around the second dryer 14A.

FIG. 7 is a perspective view of a further embodiment of the present invention. However, similar reference numerals are used to denote similar parts throughout the further embodiment with the further embodiment of FIG. 7 having numerals with the suffix B added thereto.

As shown in FIG. 7, the orifice 44B is an elongate slot which extends in a cross machine direction 72 for directing a curtain of air indicated by the arrows 46B towards the first dryer and tangentially to the first dryer thereafter and in a direction opposite to the direction of rotation of the first dryer for inhibiting any tendency of the web WB to stick to the first dryer rather than closely conforming to the felt FB between the first and second dryers.

As shown in FIGS. 7 and 8, the diverging wall 52B defines a first and second slot 96 and 98 respectively disposed adjacent to the first and second end walls 56B and 58B respectively of the box 40B. These slots 56B and 58B direct a first and second current of air indicated by the arrows 100 and 102 sideways relative to the pocket for urging the respective edges 104 and 106 of the web W into close conformity with the respective edges 108 and 110 of the felt. Such edges 104 and 106 of the web WB are shown more particularly with reference to FIG. 8 which shows the currents of air 100 and 102 tending to urge the edge 104 and 106 of the web WB closely against the edges 108 and 110 of the felt FB thereby inhibiting any tendency of the web WB from wrinkling and for inhibiting any sideways flow of hot air from the pocket. Such an arrangement as shown in FIGS. 7 and 8 is useful not only in helping to seal the pocket against loss of air, but also serves the purpose of eliminating the need of side plates for preventing such escape of air. Also, the sideways flow of air 100 and 102 prevents the outward flow of pressurized air within the pocket which had the tendency of making observation and adjustment of the dryer section 10 uncomfortable.

As shown in FIG. 8, the junction 112 of the diverging wall 52B and the end wall 56B is beveled or rounded at 97 in order to cause a substantial portion of the air jets or currents of air 100 and 102 and entrained air to follow the curved surface 97 of the end wall 56B in a direction away from the felt FB. This beveling of the end walls 56B and 58B has proved useful in keeping the air from disrupting the transfer of the tail of the web when it is in the threading ropes. Also, by deflecting the air jets 100 and 102 by the rounded edges 97, servicing and maintenance of the dryer is enhanced.

In operation of the blow box 40 according to the preferred embodiment as shown in FIG. 4, pressurized air is supplied to the blow box 40 and a portion of the air within the box 40 flows as a curtain of air 46 induces a partial vacuum in the vicinity of the diverging nip 18 thereby urging the web W into close conformity with the felt F.

As the web and felt travel together towards the second dryer 14, a lesser vacuum is generated by virtue of the location of the diverging wall 52 so that the web W between the first and second dryers tends to stay with the felt.

As the second dryer continues to rotate, air entrained by the second dryer is deflected by the brush 64 thereby inhibiting a buildup of pressure at the converging nip 24 and such diverted air flow also assists in reducing the air pressure within that portion 14 of the pocket 26 adjacent the felt and web between the second and third dryer. This reduced pressure has the tendency of drawing the web into close conformity with the felt and such tendency is augmented by the provision of the hole 86 in the base wall 48 which directs a curtain of air out of the pocket 26 thereby tending to increase such reduced pressure within the pocket.

In the event of the web W breaking, if the web W wraps around the first dryer 12, the divering wall 52 in the vicinity of the orifice 44 is urged away from the first dryer 12 by reason of the enwrapped web and the air box 40 pivots away from the first dryer 12 thereby inhibiting any possible damage to the air box 40.

Preferably, the air box 40 is pivoted such that the weight of the air box 40 normally urges the air box 40 into the position shown in FIG. 4. And, in the event of a web breakage, the thickness of the web as it enwraps around the first dryer 12 pivots the air box 40 against the weight of the air box around the pivot 68.

In operation of the alternative embodiment of the present invention as shown in FIG. 6, pressurized air is supplied to the first compartment 82 of the air box 40A and such pressurized air flows through the orifice 44A in the same way as described with the preferred embodiment. However, some of the air within the first compartment 82 also flows through the hole 86 as in the first compartment 82 towards the opening 74 defined by the base wall 48A. Such flow of air through the opening 74 tends to induce a partial vacuum within the second compartment 84 so that any air in the vicinity of the converging nip 24A will flow through the port 92 into the second compartment 84 and out through the opening 74 and out of the pocket 26A. Under certain circumstances, if the induced partial vacuum within the second compartment 84 is sufficient, it becomes unnecessary to provide a brush seal 64 as any air passing between the curved wall 50A and the periphery 22A of the second dryer 14A will be diverted back through the second compartment 84.

In operation of the third embodiment of the present invention, a portion of the pressurized air will flow respectively through the first and second slots 96 and 98 thereby causing the edges of the web to closely conform to the respective edges of the felt.

The present invention and the various embodiments described hereinbefore overcome the problem of the prior proposals by particularly utilizing the source of pressurized air to produce an under pressure in the pocket. Also, the present invention provides an air-assisted transfer which extends from the diverging to the converging nip respectively of the first and second dryer. The air flow from the orifice further serves the purpose of deflecting any air which may be entrained by the felt passing around the first dryer that would have the tendency of increasing the pressure within the pocket.

Therefore, the present invention provides a blow box of simple construction that greatly enhances the cohesion between the web and felt thereby enabling the web to be produced at a high speed.

As will be apparent to those skilled in the art, various alternatives and modifications can be made to the described embodiments without departing from the spirit and scope of the invention as set forth in the appended claims.

What is claimed is:

1. A method of maintaining a web in close conformity with a felt when the web and felt travel together from a first dryer to and around a second dryer and onto and around a third dryer, the method comprising the steps of:

directing pressurized air towards the first dryer such that the air is thereafter directed tangentially and in a direction opposite to a direction of rotation of the first dryer for urging the web against the felt for inhibiting the tendency of the web to adhere to the first dryer when the felt diverges relative to the first dryer;

generating a partial vacuum between a portion of the felt disposed between the first and second dryer and a diverging wall of a blow box, the partial vacuum being generated as a result of the diverging wall diverging in a direction from the first towards the second dryer and the movement of the felt past the diverging wall; and inhibiting a buildup of pressure at the converging nip defined by that portion of the felt between the first and the second dryer and the periphery of the second dryer, such buildup of pressure being inhibited by directing any air in the vicinity of the periphery of the second dryer out of the pocket defined by the dryers and the felt.

2. A blow box disposed within a pocket defined by a web and felt travelling together from a first dryer to and around a second dryer and on to and around a third dryer, said blow box comprising in combination:

a wedge-shaped box extending from between the first and third dryers to adjacent the second dryer, said box being connected to a source of pressurized air for maintaining the web in close conformity with the felt when the web and felt diverge relative to the first dryer;

said box defining an orifice disposed adjacent to the first dryer for directing pressurized air towards the first dryer and therafter directing the air in a direction opposite to the direction of rotation of the first dryer such that the web is urged against the felt for inhibiting the tendency of the web to adhere to the first dryer when the felt diverges relative to the first dryer;

said box further including;

a base wall extending radially relative to the second dryer to midway between the first and third dryers, said base wall extending in a cross machine direction;

a curved wall extending said base wall towards where the web and felt converge relative to the second dryer, said curved wall conforming to the periphery of the second dryer, said curved wall extending in a cross machine direction;

a diverging wall disposed opposite to said base wall, said diverging wall extending from said curved wall towards the first dryer, said diverging wall extending in a cross machine direction;

a connecting wall disposed opposite to said curved wall, said connecting wall extending between said diverging wall and said base wall for connecting said base and diverging wall together; and a first and second end wall separated relative to each other in a cross machine direction and respectively secured to said base, curved, diverging and connecting walls for defining therebetween said wedge-shaped box.

3. A blow box as set forth in claim 2 wherein said diverging wall diverges relative to the felt in a direction from the first towards the second dryer for inducing a partial vacuum between the felt and said diverging wall when said web and felt are moving relative to said box.

4. A blow box as set forth in claim 3 wherein said diverging wall is disposed in a first plane and the felt between the first and second dryers is disposed in a second plane, said first and second planes being disposed angularly relative to each other for inducing said partial vacuum such that any tendency of the web to part from the felt is inhibited by said partial vacuum.

5. A blow box as set forth in claim 4 wherein said partial vacuum increases proportionately to the speed of movement of the felt relative to said diverging wall such that when the speed of movement of the felt and web in close conformity with the felt increases and the tendency of the web to part from the felt accordingly increases, said induced partial vacuum increases correspondingly to compensate for such tendency of the web to part from the felt.

6. A blow box as set forth in claim 5 wherein said first and second planes diverge relative to each other at an angle within the range 0.1–5.0 degrees, such that said partial vacuum induced by said diverging wall assists in maintaining the partial vacuum induced by said pressurized air.

7. A blow box as set forth in claim 2 wherein said box further includes:

air deflector means extending between said base wall and said periphery of the second dryer such that when the second dryer rotates, air within the pocket and in the vicinity of said periphery of the second dryer is inhibited from flowing between said curved wall to said periphery of the second dryer towards where the web and felt converge relative to the second dryer, said deflector means deflecting the air in the vicinity of the periphery of the second dryer along said base wall and out of the pocket.

8. A blow box as set forth in claim 7 wherein said air deflector means is a brush.

9. A blow box as set forth in claim 7 wherein said air deflector means deflects air in the vicinity of the periphery of the second dryer along said base wall and out of the pocket thereby inducing a partial vacuum within the pocket between said base wall and the web and felt disposed between the second and third dryer, said partial vacuum adjacent the web and felt between the second and third dryers enhancing cohesion of the web to the felt between the second and third dryers.

10. A blow box as set forth in claim 2 wherein said base wall is pivotally-mounted relative to the first dryer such that in the event of the web breaking and becoming enwrapped around the first dryer, said box tilts relative to the first dryer such that said diverging wall moves away from the first dryer to inhibit damage to said box.

11. A blow box as set forth in claim 10 wherein said base wall is pivotally-mounted relative to the first dryer, so that said box pivots about a pivotal axis disposed parallel to the cross machine direction and remote from said connecting wall.

12. A blow box as set forth in claim 2 wherein said base wall defines an opening for directing a flow of air from within the box to the pocket such that the flow of air flows out of the pocket to induce a partial vacuum within the pocket between the base wall and the felt disposed between the second and third dryers, such induced partial vacuum tending to maintain the web in close conformity with the felt between the second and third dryers.

13. A blow box as set forth in claim 2 wherein said box further includes:

a baffle disposed within and extending across said box between said diverging and base walls such that said box defines a first and second compartment;

said first compartment being connected to a source of pressurized air, said first compartment defining a hole which is in fluid communication with said second compartment such that a partial vaccum is induced within said second compartment as a result of air flowing from said hole towards an opening defined by said base wall;

said second compartment defining a port disposed adjacent to where the web and felt converge relative to the second dryer such that air flows through said port into said second compartment for inhibiting any tendency of the web to part from the felt as the web passes around the second dryer.

14. A blow box as set forth in claim 2 wherein said orifice is an elongate slot extending in a cross machine direction for directing a curtain of air tangentially and in a direction opposite to the direction of rotation of the first dryer for inhibiting any tendency of the web to stick to the first dryer rather than closely conforming to the felt between the first and second dryer.

15. A blox box as set forth in claim 2 wherein said diverging wall defines a first and second slot disposed adjacent to said first and second end walls respectively for directing a first and second current of air sideways relative to the pocket for urging the respective edges of the web into close conformity with the respective edges of the felt thereby inhibiting any tendency of the web from wrinkling and for inhibiting sideways flow of hot air from the pocket thereby enhancing servicing and maintenance of the blow box.

16. A blow box disposed within a pocket defined by a web and a felt traveling together from a first dryer to, and around, a second dryer and onto and around a third dryer, said blow box comprising:

a wedge shaped box extending from between the first and third dryers to adjacent the second dryer, said box being connected to a source of pressurized air for maintaining the web in close conformity with the felt when the web and felt diverge relative to the first dryer;

said box defining an orifice disposed adjacent to the first dryer for directing pressurized air tangentially and in a direction opposite to the direction of rotation of the first dryer such that the web is urged against the felt for inhibiting the tendency of the web to adhere to the first dryer when the felt diverges relative to the first dryer; and said box further including:

a diverging wall extending from the first dryer to the second dryer, said diverging wall being diposed adjacent to that portion of the felt between the first and second dryer, said diverging wall diverging relative to said portion of the felt in a direction from the first towards the second dryer for inducing a partial vacuum between said portion of the felt and said diverging wall when the web and felt are moving relative to the box for urging the web into close conformity with the felt.

* * * * *

UNITED STATES PATENT AND TRADEMARK OFFICE

CERTIFICATE OF CORRECTION

PATENT NO. : 4,669,198

DATED : June 2, 1987

INVENTOR(S) : Gregory L. Wedel

It is certified that error appears in the above-identified patent and that said Letters Patent is hereby corrected as shown below:

IN THE CLAIMS

Renumber claim 16 as claim 1.

Renumber claim 1 as claim 16.

Amend the dependency of claims 3, 7 and 14 such that they depend from renumbered claim 1 rather than renumbered claim 16.

IN THE SPECIFICATION

At column 4, line 3, before "A baffle" insert --In a further embodiment of the present invention--.

At column 4, line 34, delete "one way" and insert therefore --various ways--.

At column 7, line 37, delete "74" and insert therefore --76--.

At column 8, lines 29 to 31, delete "56B and 58B" and insert therefore --56 and 58-- both occurences.

At column 8, line 35, delete "W" and insert therefore --WB--.

At column 8, lines 52 and 55, delete "56B" and insert therefore --56-- both occurences.

At column 8, line 57, delete "56B and 58B" and insert therefore --56 and 58--.

At column 8, line 65, delete "flows" and insert therefore --flowing--.

At column 9, line 10, delete "14".

At column 9, line 14, delete "hole 86" and insert therefore --opening 74--.

At column 9, line 36, delete "as".

UNITED STATES PATENT AND TRADEMARK OFFICE

CERTIFICATE OF CORRECTION

PATENT NO. : 4,669,198

DATED : June 2, 1987

INVENTOR(S) : Gregory L. Wedel

It is certified that error appears in the above-identified patent and that said Letters Patent is hereby corrected as shown below:

At column 9, lines 37, 39 and 43, delete "74" and insert therefore --90-- in all three occurences.

Signed and Sealed this

Twenty-ninth Day of November, 1988

*Attest:*

DONALD J. QUIGG

*Attesting Officer*

*Commissioner of Patents and Trademarks*